United States Patent [19]

Bishop

[11] 3,941,038

[45] Mar. 2, 1976

[54] DIE-CUTTING

[75] Inventor: Thomas Desmond Bishop, Solihull, England

[73] Assignee: The Deritend Engineering Co. Ltd., Birmingham, England

[22] Filed: Nov. 6, 1974

[21] Appl. No.: 521,347

[30] Foreign Application Priority Data

Mar. 16, 1974 United Kingdom ..... 11771/74

[52] U.S. Cl. ..... 93/58.4; 76/107 C; 83/698; 93/58.2 R; 93/59 R

[51] Int. Cl.[2] ..... B31B 1/14; B26D 7/26

[58] Field of Search ..... 76/107 R, 107 C; 93/58 R, 93/58.1, 58.2 R, 58.2 F, 58.3, 58.4, 58.5, 59 R; 83/348, 583, 657, 675, 678, 698

[56] References Cited

UNITED STATES PATENTS

| | | | |
|---|---|---|---|
| 3,000,251 | 9/1961 | Berlin et al. | 76/107 C X |
| 3,145,586 | 8/1964 | Brearley et al. | 76/107 R |
| 3,152,492 | 10/1964 | Whitecotton | 76/107 C |
| 3,433,107 | 3/1969 | Horton et al. | 83/348 X |
| 3,527,123 | 9/1970 | Dovey | 76/107 R |
| 3,623,405 | 11/1971 | Bishop | 93/58.2 R |
| 3,835,746 | 9/1974 | Young, Jr. et al. | 83/698 X |

*Primary Examiner*—James F. Coan
*Attorney, Agent, or Firm*—Marshall & Yeasting

[57] ABSTRACT

The invention provides a forme construction for a die cutting apparatus in which cutting rule is supported in slots in a relatively massive support plate by using sinuous resilient elements lying between walls of slots in the support plate and the sides of the rule.

9 Claims, 4 Drawing Figures

DIE-CUTTING

BACKGROUND OF THE INVENTION

This invention relates to formes for die-cutting (and like operations) on card and like materials.

One known forme construction comprises a sheet of plywood which is saw-cut to create grooves into which cutting rule is jammed, edge-on, and this construction has been used for both flat and curved formes — that is for both flat-bed and rotary die-cutting. However the dimensional accuracy is low, not only because of the nature of plywood, but also because it is necessary to interrupt the cuts lest the plywood become severed into separate pieces, and to notch the rule so as to span the gap between successive saw-cuts, and the rule is weak and relatively unsupported in these areas: alternatively the several pieces of plywood have to be joined together by separate means and the security of hold of the rule is then at risk. Different thicknesses of rule are used for different purposes i.e. cutting soft corrugated board, thin card, or thick cardboard, and if the plywood is sawn for one rule, and then it is found necessary to use another, the sawn plywood may be scrapped because its saw cut is too narrow or too wide to afford the necessary grip to the rule, especially with rotary die-cutting.

An alternative forme construction uses sheet metal as the support, and studs welded to the sheet, the rule being secured to the studs. This has advantages in that the rule abuts the sheet metal to provide a firm base, and if notched the notches are smaller in length being merely to span a stud, but the length of rule between each two studs is only supported laterally by the stiffness of the rule, and increasing the number of studs to provide better lateral support brings problems especially where the total area of the pattern to be cut and like by the rule is small and intricate.

SUMMARY OF THE INVENTION

The object of the present invention is to provide an improved forme construction.

In accordance with a first aspect of the present invention, a forme comprises a support provided with a pattern of slots each of a width greater than that of the rule which is arranged in the said pattern and with each length of rule between successive notches located in the slots, said rule being held in the slots by individual sinuous blade-like and resilient elements each arranged between one lateral side of the rule and the adjacent side of the slot.

Hence, in this broadest aspect of the invention the problem of holding the rule securely is overcome since the resilient elements can be designed to provide a required force to hold the rule securely in place. Moreover, and according to a first preferred feature of the invention, the opposite side of the rule abuts a shim which serves to locate the rule laterally of the slot and then in the event that a rule of different thickness is employed, a correspondingly thinner or thicker shim may be employed to hold each rule accurately in a fixed position, so as to enable the line of cut made by both rules to be in exactly the same position; e.g. the rule is centralised in the slot by the shim.

Alternatively, the shim is omitted or replaced by a second resilient element as shown in FIG. 4.

It is preferred to employ a support sheet of substantial thickness, by which is meant say ¼ inch or ⅛ inch rather than sheet metal of a mere few hundredths of an inch thickness so as to provide a substantial area for contact by the shim packing (if used) and by the resilient element in order to hold the rule securely in a fixed position and thus avoid risk of the rule tilting laterally. Both the shims and the resilient elements may project above the face of the sheet, to provide support for the rule. The support sheet could be made of many materials, e.g. plywood, a plastics material, or a metal such as a semi-hard aluminium. A material with a high tensile strength — e.g. aluminum — as compared to some plywoods — is preferred as this enables any gaps between adjacent ends of slots to be small without excessively weakening the forme, and so that the rule may be notched to bridge these gaps without either excessively weakening the rule or providing long lengths of poorly supported rule.

However, the slots may be continuous to avoid notching the rule at all, by using a block-die construction, in which blocks are attached to a backing sheet to create the slots between adjacent edges of the blocks.

A preferred form for the resilient elements is a springy sheet metal strip formed into a zig-zag shape; the width of the strip (the length of each rib or channel formed by the sinuousity) corresponding at least to the thickness of the support plate or like, and the formed length transversely of the ribs or channels being slightly less than the length of each slot. When pressed into the gap between the rule and the slot side, so that the ribs extend transversely of the rule, the latter is contacted at a plurality of parallel lines, and the slot side likewise. Any slight flattening of the element caused by compression of the ribs in this action may be accompanied by slight lengthening of the element. Suitable corrugated elements are available commercially as used for joining two pieces of wood which lie side-by side.

Where a thick metal plate is used for the forme support, the slots may be milled, and conveniently a punched tape controlled milling machine is employed: such machines exist both for machining in areas defined by X and Y axes at right angles to one another, and also for machining in areas defined by an X axis and a rotational axis, i.e. both along and about an axis, and these will be suitable for flat plates and rotary type formes respectively. In the latter case the generation of the tap for milling slots either parallel to the X axis or arcuately in a plane normal to the axis is straightforward, but the cutting of slots in position to locate the rule so as to cut circles or ellipses (for example) when the forme is in use, is more complex, but readily capable of creation by computer programming.

In general, the forme provided by the invention (in the case of a rotary die cutter) may be laid directly on a hardened roll so that the rules will seat on the roll surface, for cutting with a high degree of accuracy. If an unhardened roll is in use, the support sheet will normally be permanently backed by a sheet metal layer e.g. of stainless steel. According to a feature of the invention, the sheet is made of a laminar material including at least one layer of metal and at least one layer of non-metal. The support sheet may be of a sandwich material for example comprising a plywood having a metal bonded to one or both faces. Alternatively, the laminar material may comprise a cardboard, millboard or the like with a metal facing on one or both faces, or plastics laminates especially thermosetting plastics such as those sold under the Registered Trade Mark BAKELITE, FORMICA, and the like.

If the laminar material does include metal, and this is on one face only, it is preferred that this should be the face which is uppermost, that is located towards the cutting edge of the rule, and more remote from the plain edge of the rule, as shown in FIG. 4, since the resilient elements will normally be inserted into the slots in the support from above.

DESCRIPTION OF THE PREFERRED EMBODIMENTS

Figure 3:
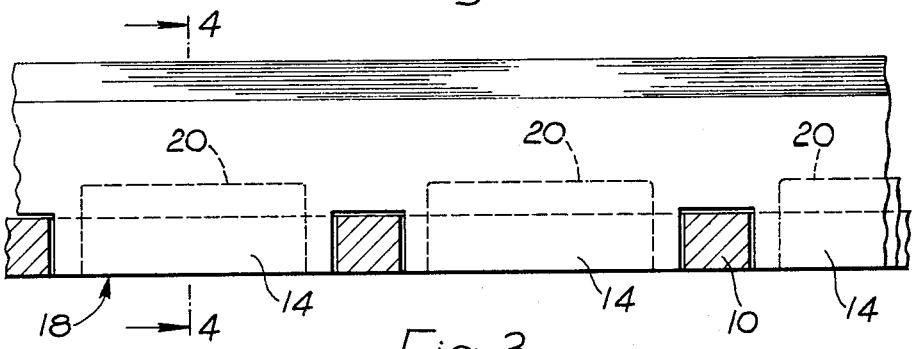
FIG. 3 is a section taken on the line 3—3 of FIG. 2.

The drawings are somewhat diagrammatic, and do not show details such as any ties, clamps or the like for attaching the forme to the roll in a die-cutting machine. The forme comprises a support sheet 10, of substantial thickness, and made of any of the materials, or composite materials as explained hereinbefore. The support sheet is apertured to provide series of slots 12, which extend generally along the line to be followed by the cutting rule. The rule, as best seen in FIG. 3, is notched so that portions 14 located on the margins opposite to the cutting edge 16 lie within the respective slots and so that the free edge 18 opposite the cutting edge is coplanar with the undersurface of the support sheet 10.

The rule is aligned transversely with respect to the slots by packing shims 20, selected to be of a suitable width, and capable of being interchanged for others of different width if it is required to adjust the lateral position of the rule at any point.

Figure 1:
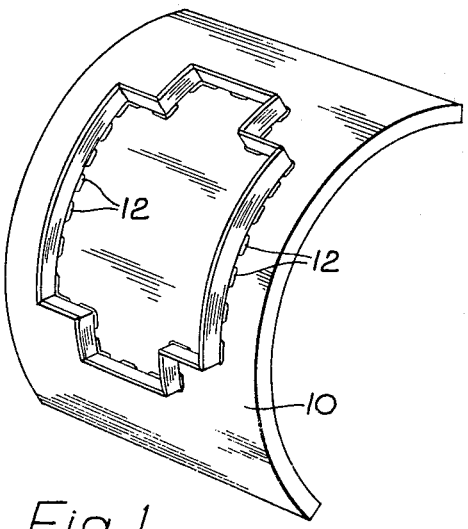
FIG. 1 is a perspective view of a forme.
Figure 4:
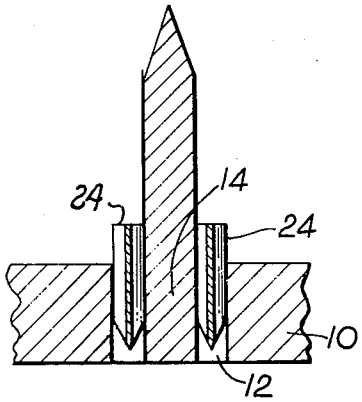
FIG. 4 is a section taken on the line 4—4 of FIG. 3, but showing the assembly partly completed, as will be more particularly explained hereinafter.
Figure 2:
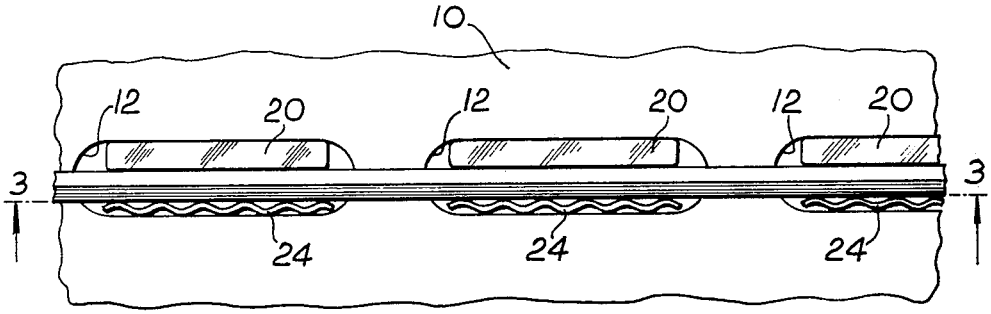
FIG. 2 is a fragmentary plan view of the same.

On the side of the rule opposite to the shims are located a series of resilient elements 24, also as more particularly hereinbefore described. FIG. 4 shows one such element 24 partly inserted into the space between the rule and the adjacent edge of the slot, and the element may be driven home so as to secure the rule in position. The resilient elements preferably have the lower edge, which is inserted first into the slot, tapered to facilitate insertion, but with the taper extending only over a short distance so as to give maximum support to the rule over the non-tapered area.

It will be appreciated that many variations are possible within the scope of the invention as defined by the accompanying claims.

I claim:

1. A forme in which a rule is held securely and accurately in position, comprising a plate-like support provided with a pattern of slots, each slot being wider than the thickness of the rule, the rule being mounted in the slots, at least two slots being aligned, with an intervening gap, and the rule having a notch to accommodate said gap, and a retaining element having a press fit beside the rule in each slot, said element consisting of a corrugated strip of sheet metal, the corrugations being rectilinear and parallel to one another, running transversely of the rule, and having linear contact with the rule and with the side of the slot, and the force exerted against the rule and the side of the slot by the corrugated strip being great enough to hold the rule securely and accurately in position and to prevent tilting of the rule.

2. A forme according to claim 1 wherein each slot accommodates two of the aforesaid retaining elements, one located on each side of the rule.

3. A forme according to claim 1 wherein each slot is of a width exceeding the combined thicknesses of the rule and the retaining element inserted into the slot on one side of the rule, and wherein the excess width of the slot is taken up by a shim removably located on the opposite lateral side of the rule.

4. A forme according to claim 1 in which the width of each corrugated retaining element exceeds the depth of the associated slot, and a portion of each element is in contact with the rule where it projects beyond the slot.

5. A forme according to claim 4 in which said slots each extend through the entire thickness of the support, and the corrugated elements are beveled along that edge which is introduced into the associated slot.

6. A forme according to claim 1 in which said slots each extend through the entire thickness of the support.

7. A forme according to claim 1 in which the corrugated elements are beveled along that edge which is introduced into the associated slot.

8. A forme according to claim 1 in which the support is in the form of a metal sheet.

9. A forme according to claim 1 in which the support comprises a laminar material including at least one layer of metal and at least one layer of non-metal, there being a metal layer at the surface of the support from which the rule extends.

* * * * *